US010575707B2

(12) United States Patent
Ryan

(10) Patent No.: US 10,575,707 B2
(45) Date of Patent: Mar. 3, 2020

(54) DISHWASHER APPLIANCES AND USER INTERFACES

(71) Applicant: Haier US Appliance Solutions, Inc., Wilmington, DE (US)

(72) Inventor: Jeremy Joseph Ryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 344 days.

(21) Appl. No.: 15/672,359

(22) Filed: Aug. 9, 2017

(65) Prior Publication Data

US 2019/0046003 A1 Feb. 14, 2019

(51) Int. Cl.

| | |
|---|---|
| ***A47L 15/42*** | (2006.01) |
| ***H01H 13/70*** | (2006.01) |
| ***H01H 13/83*** | (2006.01) |
| ***H01H 21/22*** | (2006.01) |

(52) U.S. Cl.

CPC ..... *A47L 15/4293* (2013.01); *A47L 15/4223* (2013.01); *H01H 13/70* (2013.01); *H01H 13/83* (2013.01); *H01H 21/22* (2013.01); *H01H 2219/062* (2013.01); *H01H 2231/012* (2013.01); *H01H 2237/004* (2013.01)

(58) Field of Classification Search

CPC . A47L 15/4223; A47L 15/4293; H01H 13/70; H01H 13/83; H01H 21/22; H01H 2219/062; H01H 2231/012; H01H 2237/004

USPC ..... 134/56 D, 57 D, 58 D, 113

See application file for complete search history.

(56) References Cited

U.S. PATENT DOCUMENTS

| | | | | |
|---|---|---|---|---|
| 4,139,756 | A | 2/1979 | Tsen et al. | |
| 7,415,846 | B2 | 8/2008 | Park | |
| 2005/0193778 | A1* | 9/2005 | Park | D06F 39/005 68/3 R |
| 2015/0320289 | A1* | 11/2015 | Stutts | A47L 15/488 134/57 D |

FOREIGN PATENT DOCUMENTS

| | | |
|---|---|---|
| CN | 1979706 A | 6/2007 |

* cited by examiner

*Primary Examiner* — Levon J Shahinian
(74) *Attorney, Agent, or Firm* — Dority & Manning, P.A.

(57) ABSTRACT

A dishwasher appliance and user interface are generally provided herein. The user interface may be provided on the dishwasher appliance and include a control panel, a button body, a board housing, and a control board. The button body may be slidably mounted to the control panel. The board housing may be disposed behind the control panel along a transverse direction. The board housing may include a planar frame and a resilient cantilever. The planar frame may define a switch aperture in transverse alignment with the button body. The resilient cantilever may extend from the planar frame in forward biased engagement with the button body. The control board may be fixed to the board housing and include a contact switch positioned in transverse alignment with the switch aperture to selectively engage the button body.

19 Claims, 9 Drawing Sheets

DISHWASHER APPLIANCES AND USER INTERFACES

FIELD OF THE INVENTION

The present subject matter relates generally to appliance user interfaces, and more particularly to appliance user interfaces for dishwasher appliances.

BACKGROUND OF THE INVENTION

Appliances, such as dishwasher appliances, generally include one or more user interfaces. The user interface is often provided to receive instructions or provide feedback to a user regarding operation of the appliance. For instance, a display and/or one or more input selectors may be provided as part of a user interface. Selections regarding specific operations may be made at an input selector and reflected by a display. In the case of dishwasher appliances, one or more buttons are provided to receive command instructions from a user. Through the input of such commands, the user may control the operation of the appliance.

The design of the buttons on the user interface is important to the overall consumer satisfaction with the appliance. In order to satisfy consumers, the buttons must have a satisfactory fit and feel. Thus, the buttons should be small to fit within a limited space provided by the control panel and should provide a soft, consistent feel to consumers as they depress the button.

Currently, many buttons on appliance user interface include button springs, such as coil springs, that are designed to adjust from an undepressed configuration to a depressed configuration when a user of the appliance pushes the button and return to the undepressed configuration when the user releases the button. When depressed, the button may engage a switch. The design of the button springs thus affects the fit and feel of the buttons on the control panel. For instance, in many current appliance interface designs, the spring tends to provide a variable force as it is depressed. Furthermore, the spring may be difficult to align or keep aligned during use. In some cases, the spring may drift when the button is depressed. In other words, the button will have a loose feel and move perpendicularly to the intended axis of movement (i.e., the direction in which the button is being depressed). In some instances, the button may become so misaligned that it fails to consistently move or displace to the same point. In turn, the button may fail to activate the intended switch. Thus, the button may not suitably communicate with the switch of the user interface on a consistent basis.

Accordingly, it would be advantageous to provide an appliance or appliance user interface that addresses one or more of the above issues. In particular, it may be advantageous to provide an appliance or appliance user interface having a consistent feel, improved assembly, and reduced drift.

BRIEF DESCRIPTION OF THE INVENTION

Aspects and advantages of the invention will be set forth in part in the following description, or may be obvious from the description, or may be learned through practice of the invention.

In one aspect of the present disclosure, an appliance user interface is provided. The appliance user interface may include a control panel, a button body, a board housing, and a control board. The button body may be slidably mounted to the control panel. The board housing may be disposed behind the control panel along a transverse direction. The board housing may include a planar frame and a resilient cantilever. The planar frame may define a switch aperture in transverse alignment with the button body. The resilient cantilever may extend from the planar frame in forward biased engagement with the button body. The control board may be fixed to the board housing and include a contact switch positioned in transverse alignment with the switch aperture to selectively engage the button body.

In another aspect of the present disclosure, a dishwasher appliance is provided. The dishwasher appliance may include a cabinet defining an interior, a tub, a control panel, a button body, a board housing, and a control board. The tub may be disposed within the interior and define a wash chamber for the receipt of articles for cleaning. The control panel may be mounted to the cabinet. The button body may be slidably mounted to the control panel. The board housing may be disposed behind the control panel along a transverse direction. The board housing may include a planar frame and a resilient cantilever. The planar frame may define a switch aperture in transverse alignment with the button body. The resilient cantilever may extend from the planar frame in forward biased engagement with the button body. The control board may be fixed to the board housing and include a contact switch positioned in transverse alignment with the switch aperture to selectively engage the button body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
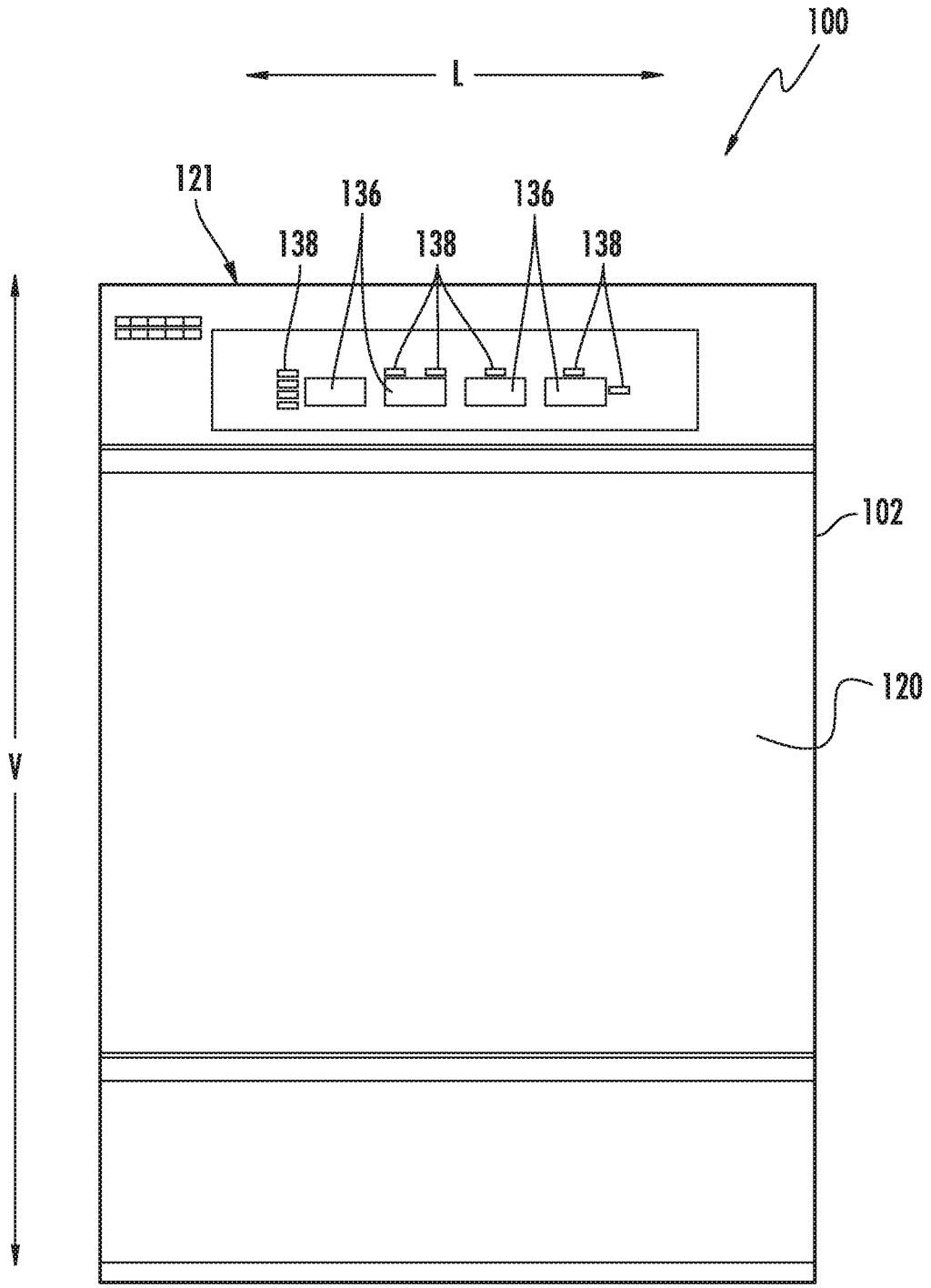
FIG. 1 provides a front view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may provide a dishwasher appliance and/or appliance user interface having one or more buttons. At least one button may be pushed or biased forward by one or more resilient cantilevers aligned behind the button. The resilient cantilevers may hold the button at a desired position when not in use and provide a linear force feel when the button is being used (e.g., depressed).

Figure 2:
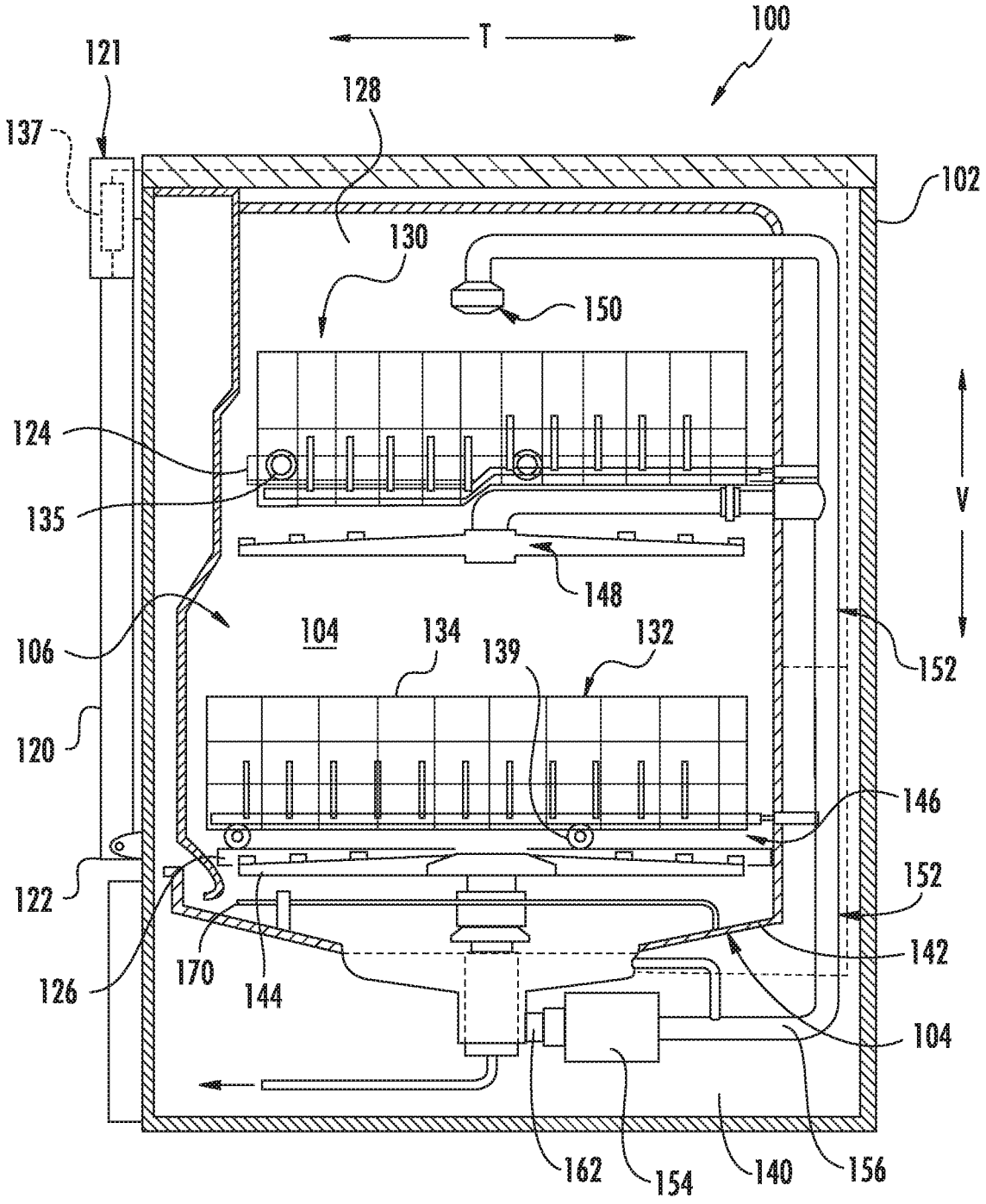
FIG. 2 provides a cross-sectional side view of the exemplary dishwashing appliance of FIG. 1.
Figure 3:
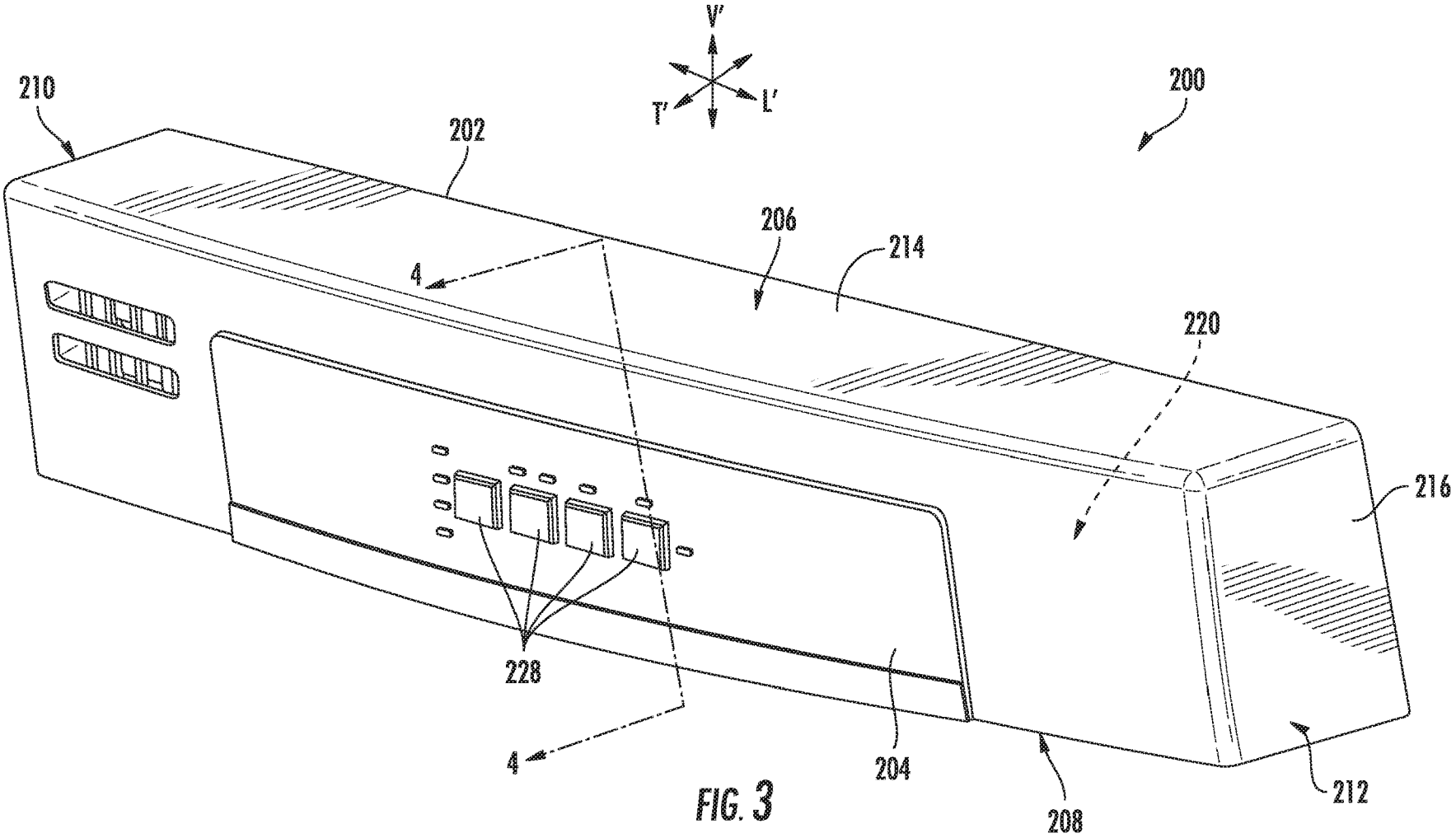
FIG. 3 provides a perspective view of an appliance user interface according to exemplary embodiments of the present disclosure.
Figure 4:
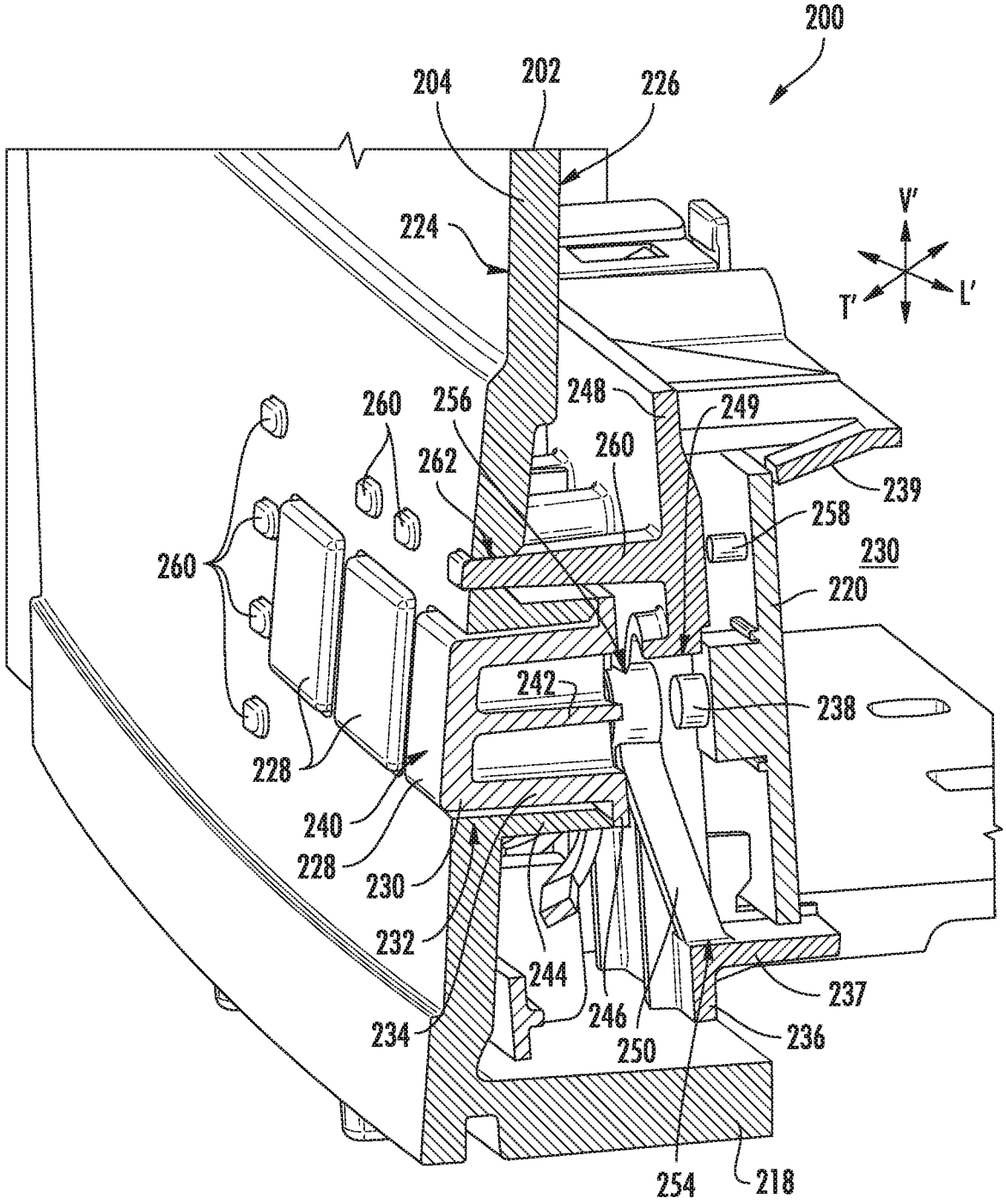
FIG. 4 provides a cross-sectional perspective view of the exemplary appliance user interface of FIG. 3, taken along the line 4-4.
Figure 5:
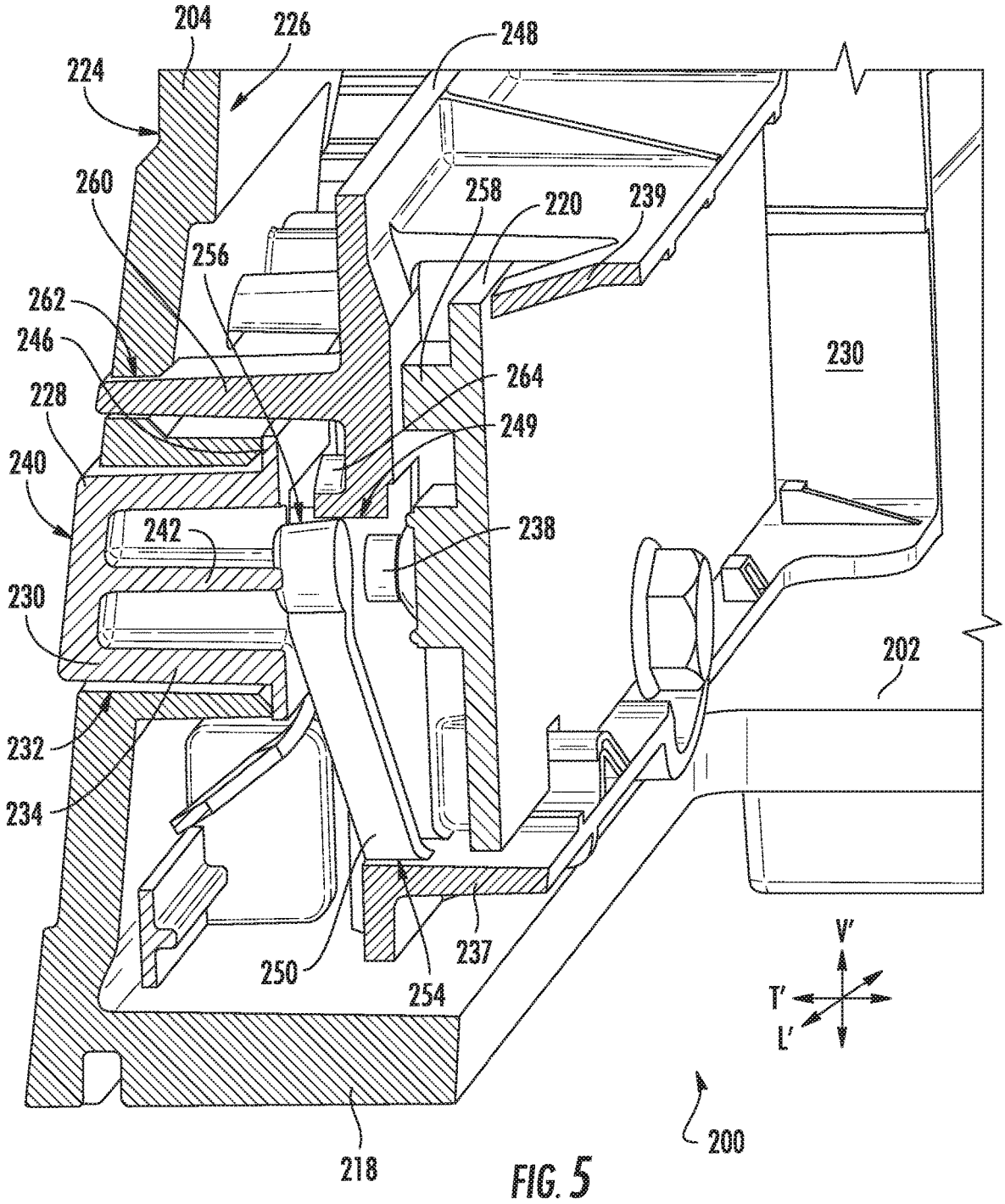
FIG. 5 provides a rear, cross-sectional perspective view of the exemplary appliance user interface of FIG. 4.
Figure 6A:
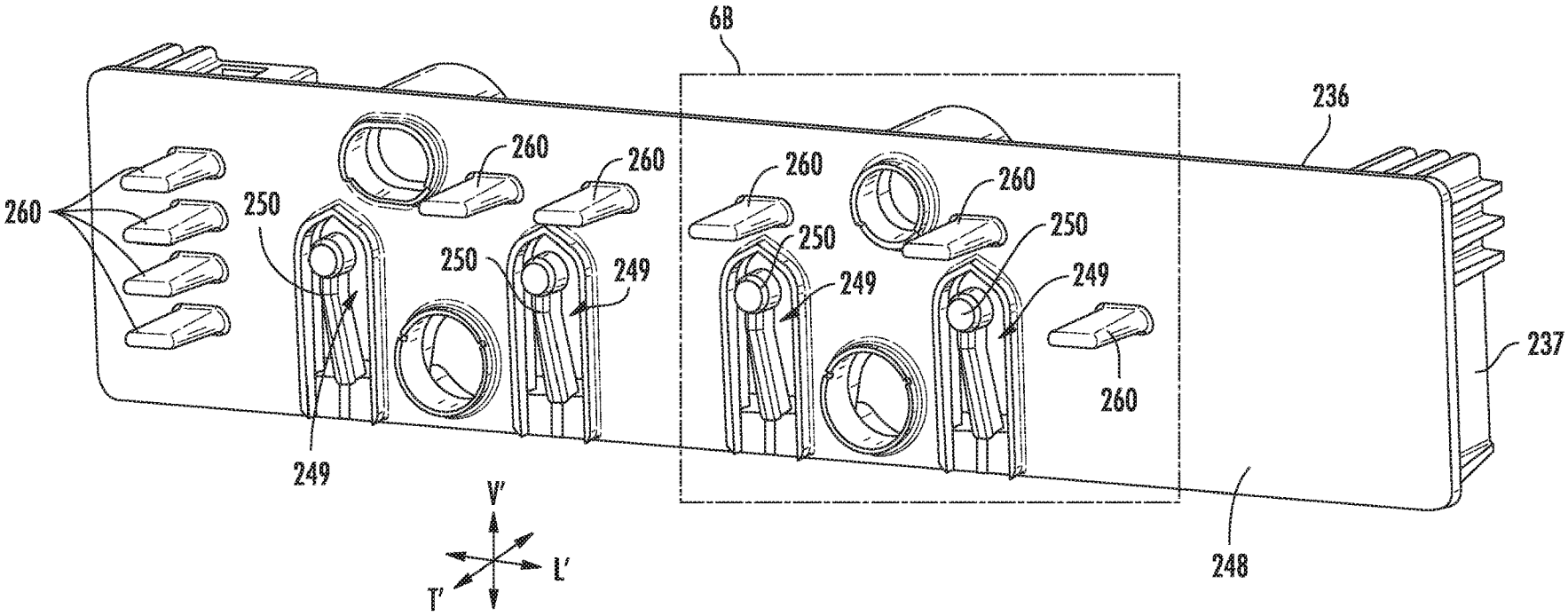
FIG. 6A provides a perspective view of a board housing of the exemplary appliance user interface of FIG. 4.
Figure 6B:
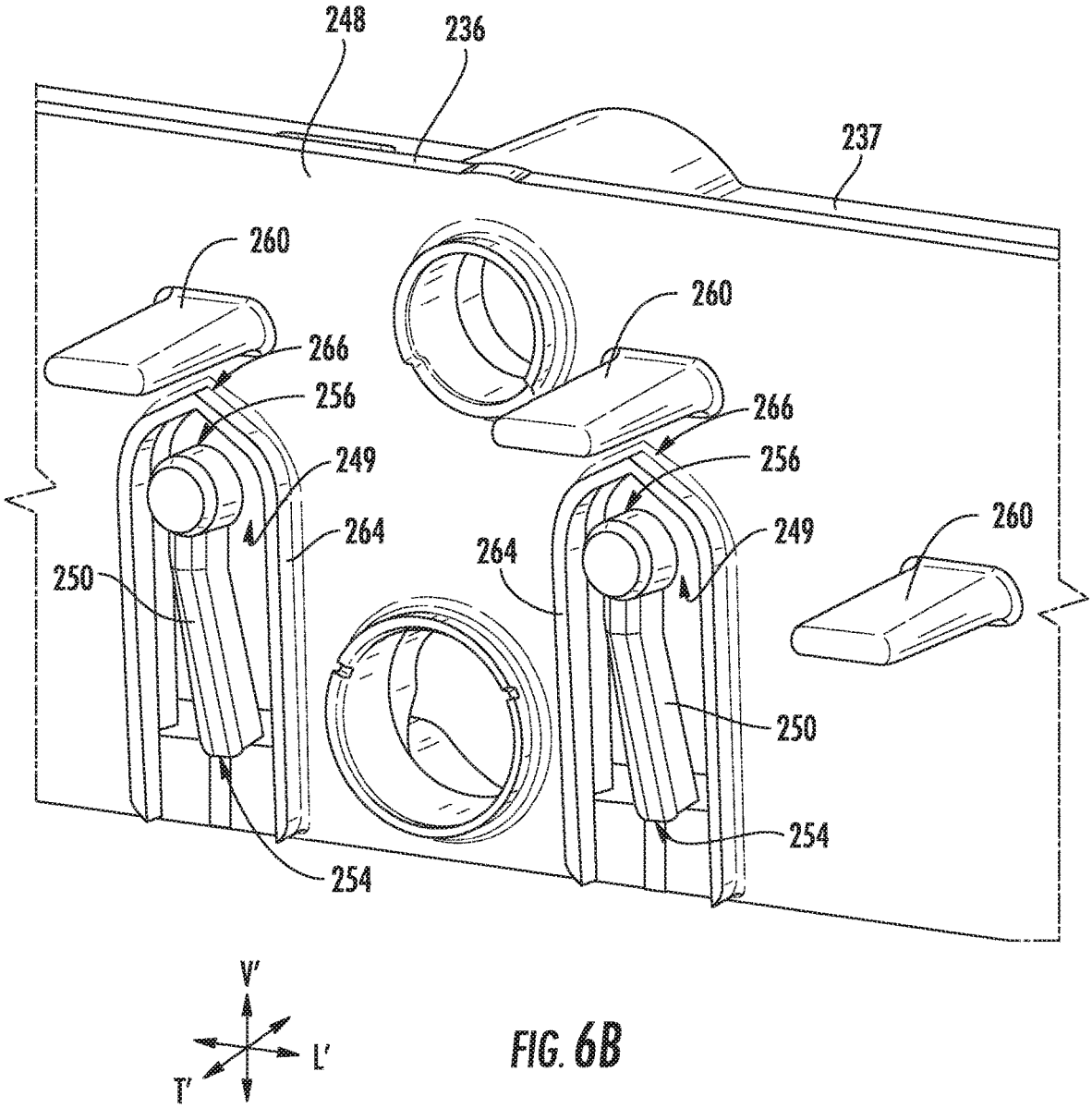
FIG. 6B provides a magnified perspective view of the portion 6B identified in FIG. 6A.

Turning now to the figures, FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. Generally, cabinet 102 defines a vertical direction V, a lateral direction L, and a transverse direction T. The vertical direction V, lateral direction L, and transverse direction T are all mutually perpendicular and form an orthogonal appliance direction system. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher 100.

Upper and lower guide rails 124, 126 are mounted on tub side walls 128 and accommodate roller-equipped rack assemblies 130 and 132. In optional embodiments, each of the rack assemblies 130, 132 is fabricated as lattice structures including a plurality of elongated members 134 (for clarity of illustration, not all elongated members forming assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement may be facilitated by rollers 135 and 139 that are, for example, mounted onto racks 130 and 132, respectively. A silverware basket (not shown) may be removably attached to rack assembly 132 for placement of silverware, utensils, and the like that are otherwise too small to be accommodated by the racks 130, 132.

In some embodiments, the dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The lower and mid-level spray-arm assemblies 144, 148 and the upper spray assembly 150 are part of a fluid circulation assembly 152 for circulating a wash fluid, such as water and/or dishwasher fluid, in the tub 104. In turn, fluid circulation assembly 152 may provide a flow of wash fluid within the wash chamber 106. For instance, fluid circulation assembly 154 includes a water inlet hose 172 in fluid communication with the wash chamber 106 (e.g., through a bottom wall and/or sidewall of tub 104) to supply water thereto. The sump portion 142 may thus be filled with water through a fill port 175 that outlets into wash chamber 106. A water supply valve 174 may be provided to control water to the wash chamber 106. Water supply valve 174 may have a hot water inlet 176 that receives hot water from an external source, such as a hot water heater and a cold water input 178 that receives cold water from an external source. It should be understood that the term "water supply" is used herein to encompass any manner or combination of valves, lines or tubing, housing, and the like, and may simply comprise a conventional hot or cold water connection.

In some embodiments, the fluid circulation assembly 152 also includes a recirculation pump 154 disposed in a machinery compartment 140 located below the tub sump portion 142 (i.e., below a bottom wall) of the tub 104. The recirculation pump 154 receives fluid from sump 142 to provide a flow to assembly 152, or optionally, a switching valve or diverter (not shown) may be used to select flow. A heater 170 can be used to provide heat during, e.g., a wash, rinse, and/or drying cycle. Optionally, heater 170 may be a resistive heating element, such as a type sold under the name CALROD®. Additionally or alternatively, an inline heating element may be provided within fluid circulation assembly 152 to provide heat to wash fluid flowing therethrough.

Each spray-arm assembly 144, 148 includes an arrangement of discharge ports or orifices for directing washing fluid received from the recirculation pump 154 onto dishes or other articles located in rack assemblies 130 and 132. The arrangement of the discharge ports in spray-arm assemblies 144, 148 may provide a rotational force by virtue of washing fluid flowing through the discharge ports. The resultant rotation of the spray-arm assemblies 144, 148 and the operation of the spray assembly 150 using fluid from the recirculation pump 154 provides coverage of dishes and other dishwasher contents with a washing spray. Other configurations of spray assemblies may be used as well.

The dishwasher appliance 100 is further equipped with a control board or controller 137 disposed within a user interface 121. Generally, controller 137 may be configured to regulate operation of the dishwasher appliance 100. The controller 137 may include one or more memory or memory devices (e.g., non-transitory storage media) and one or more microprocessors, such as general or special purpose microprocessors operable to execute programming instructions or micro-control code associated with a cleaning cycle. The memory device may represent random access memory such as DRAM or read only memory such as ROM or FLASH. In one embodiment, the processor executes programming instructions stored in memory devices. For certain embodiments, the instructions include a software package configured to operate dishwasher appliance 100 and execute one or more cleaning cycles. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. In some embodiments, controller 137 is in communication (e.g., electrically connected or coupled) with pump 154 and/or heater 170 via one or more signal lines or shared communication busses.

In certain embodiments, user interface 121 and controller 137 are mounted to door 120 (e.g., to rotate therewith), as shown in FIGS. 1 and 2. Alternatively, user interface 121 and controller 137 may be mounted directly to cabinet 102 above door 120 (e.g., such that door 120 may rotate independent of user interface 121). Input/output ("I/O") signals may be routed between the control system and various operational components of dishwasher appliance 100 along one or more wiring harnesses that may, for example, be routed through the bottom 122 of door 120. As will be described in detail below, user interface 121 includes one or more controls 136 through which a user may select various operational features and modes and monitor progress of the dishwasher appliance 100. In exemplary embodiments, the controls 136 may represent a general purpose I/O ("GPIO") device or functional block. For instance, the controls 136 may include input components, such as one or more of a variety of electrical, mechanical, or electro-mechanical input devices including rotary dials, push buttons, and touch pads. Specifically, controls 136 include at least one button. Optionally, the user interface 121 may include a display component 138, such as a digital or analog display device designed to provide operational feedback to a user. The controls 136 and/or display component 138 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 121, different configurations may be provided for racks 130, 132, and other differences may be applied as well.

Turning now to FIGS. 3 through 6B, various views of an appliance user interface 200, including components thereof, are provided. It is understood that appliance user interface 200 may be provided as user interface 121 mounted to cabinet 102, described above. Alternatively, appliance user interface 200 may be provided on another suitable location or appliance to receive input directing operations thereof.

As shown, appliance user interface 200 generally defines a vertical direction V', a lateral direction L', and a transverse direction T'. The vertical direction V', lateral direction L', and transverse direction T' are all mutually perpendicular and form an orthogonal interface direction system. It is understood that in some embodiments wherein appliance user interface 200 is mounted to cabinet 102, as illustrated in FIGS. 1 and 2, the orthogonal direction systems may be aligned during cleaning operations. In other words, the vertical direction V', lateral direction L', and transverse direction T' may be parallel to the vertical direction V, lateral direction L, and transverse direction T, respectively.

In some embodiments, appliance user interface 200 includes a shell 202 having a control panel 204. For instance, control panel 204 may extend along the vertical direction V' between an upper end 206 and a lower end 208. Control panel 204 may further extend along the lateral direction L' between a first end 210 and a second end 212. A top panel 214 may extend rearward along the transverse direction T' from control panel 204 at the upper end 206. Similarly, a side panel 216 may extend rearward along the transverse direction T' from each of first end 210 and second end 212. A bottom panel 218 may extend rearward along the transverse direction T' from control panel 204 at the lower end 208. Together, panels 214, 216, 218 may define an enclosed cavity 220 in which a control board 222 (e.g., provided as controller 137—FIG. 2) is mounted. A forward face 224 of control panel 204 is generally directed away from enclosed cavity 220 while an opposing rearward face 226 is directed toward enclosed cavity 220.

Generally, one or more buttons 228, each having a button body 230, are slidably mounted to control panel 204. A board housing 236 disposed behind control panel 204 (e.g., rearward in the transverse direction T') may hold control board 222 in a fixed position relative to control panel 204. For instance, control board 222 may be aligned with the buttons 228. In turn, each button body 230 may selectively move into and out of engagement with a portion of control board 222 (e.g., a contact switch 238 included on control board 222).

In some embodiments, a button body 230 is slidably mounted within a portion of control panel 204. For instance, control panel 204 may define a panel aperture 232 in which button body 230 slidably mounted. For instance, panel aperture 232 may extend fully through control panel 204 from forward face 224 to rearward face 226 along the transverse direction T'. A forward engagement face 240 of button body 230 may be supported within panel aperture 232 by a body sidewall 234 that is coaxial with panel aperture 232 and/or parallel to the transverse direction T'. During use, a user may engage or depress the button 228 at the forward engagement face 240 to force the button 228 rearward along the transverse direction T' within panel aperture 232. Optionally, an engagement prong 242 may extend behind forward engagement face 240 (e.g., rearward along the transverse direction T') in transverse alignment with contact switch 238. In other words, engagement prong may be positioned along a common axis with the contact switch 238 that parallel to the transverse direction T'. Thus, as the button 228 is depressed, prong 242 may engage contact switch 238 (e.g., in direct contact or indirect contact).

As illustrated, a perimeter wall 244 may extend rearward from control panel 204. Specifically, perimeter wall 244 may extend along (e.g., parallel to) the transverse direction T' from rearward face 226. As shown, the perimeter wall 244 is positioned within the enclosed cavity 220. Moreover, perimeter wall 244 may extend about panel aperture 232. In turn, perimeter wall 244 may be coaxial with panel aperture 232 and button body 230. In additional or alternative embodiments, button 228 includes a flanged edge 246 that extends radially outward from button body 230 (e.g., at body sidewall 234). Flanged edge 246 may be positioned at a rearward portion of button body 230, opposite from forward engagement face 240, and/or behind control panel 204. Flanged edge 246 may extend further radially outward than panel aperture 232 (e.g., outward from an inner surface of perimeter wall 244). During use, the forward transverse movement of the button body 230 may thus be limited by engagement between flanged edge 246 and control panel 204 (e.g., at perimeter wall 244). Moreover, flanged edge 246 may advantageously prevent moisture from traveling into enclosed cavity 220 through panel aperture 232, which might otherwise damage control board 222.

As shown, board housing 236 is disposed behind control panel 204 along the transverse direction T' (e.g., within enclosed cavity 220). Generally, board housing 236 includes a planar frame 248 and a resilient cantilever 250. Behind board housing 236, control board 222 is mounted. In other words, board housing 236 is generally positioned between control panel 204 and control board 222 along the transverse direction T'. As shown, a switch aperture 249 may be defined through planar frame 248 (e.g., fully from a forward surface to a rearward surface along the transverse direction T'). About switch aperture 249, an aperture wall 252 may extend, for instance, toward control panel 204 in the transverse direction T' from planar frame 248. Moreover, when assembled, switch aperture 249 may be in transverse alignment with contact switch 238. Button body 230 may be similarly aligned therewith. Thus, button body 230 may be selectively moved into engagement with contact switch 238 (e.g., to select various operations of dishwasher appliance 100—FIG. 1).

Resilient cantilever 250 extends from planar frame 248. Specifically, cantilever 250 may extend arcuately toward control panel 204 from a supported end 254 to a free end 256. When assembled, the free end 256 of cantilever 250 is generally movable along the transverse direction T' while the supported end 254 remains fixed relative to planar frame 248. The portion of cantilever 250 between the ends may thus bend or flex in response to an applied force, before elastically returning to a resting forward position once the applied force is removed. In some such embodiments, the resilient cantilever 250 may be integral with planar frame 248 (e.g., as a unitary monolithic body), advantageously improving assembly and maintain alignment between cantilever 250 and planar frame 248.

In some embodiments, cantilever 250 is positioned in forward biased engagement (e.g., in direct contact or indirect contact) with the button body 230. The free end 256, in particular, may be held against a rear portion of button body 230 (e.g., prong 242). When assembled, cantilever 250 thus may bias or motivate button body 230 forward toward control panel 204 (e.g., through panel aperture 232). As the button 228 is depressed, cantilever 250 may thus maintain an advantageously stable, biased engagement with button body 230, without risking misalignment. In other words, the button body 230 will be permitted to reliably move in a linear motion rearward along the transverse direction T' before being returned to an original forward position. Moreover, during non-use (e.g., when a user is not engaging or depressing button 228), cantilever 250 may maintain tension with button body 230, advantageously ensuring button 228 is stabilized in a desired position.

In certain embodiments, resilient cantilever 250 extends in front of switch aperture 249, as illustrated in FIGS. 4 through 6B. In other words, resilient cantilever 250 may extend arcuately across at least a portion of switch aperture 249. Moreover, resilient cantilever 250 may be in transverse alignment with switch aperture 249. As shown, the free end 256 may be positioned between button body 230 and switch aperture 249. Contact switch 238 may be further aligned with the free end 256 of cantilever 250 in such embodiments. Therefore translation of button body 230 along the transverse direction T' may the force free end 256 into engagement (e.g., direct contact or indirect contact) with contact switch 238. In some such embodiments, the free end 256 of cantilever 250 is disposed between the button 228 and contact switch 238 such that button body 230 engages contact switch 238 through the free end 256.

Figure 7A:
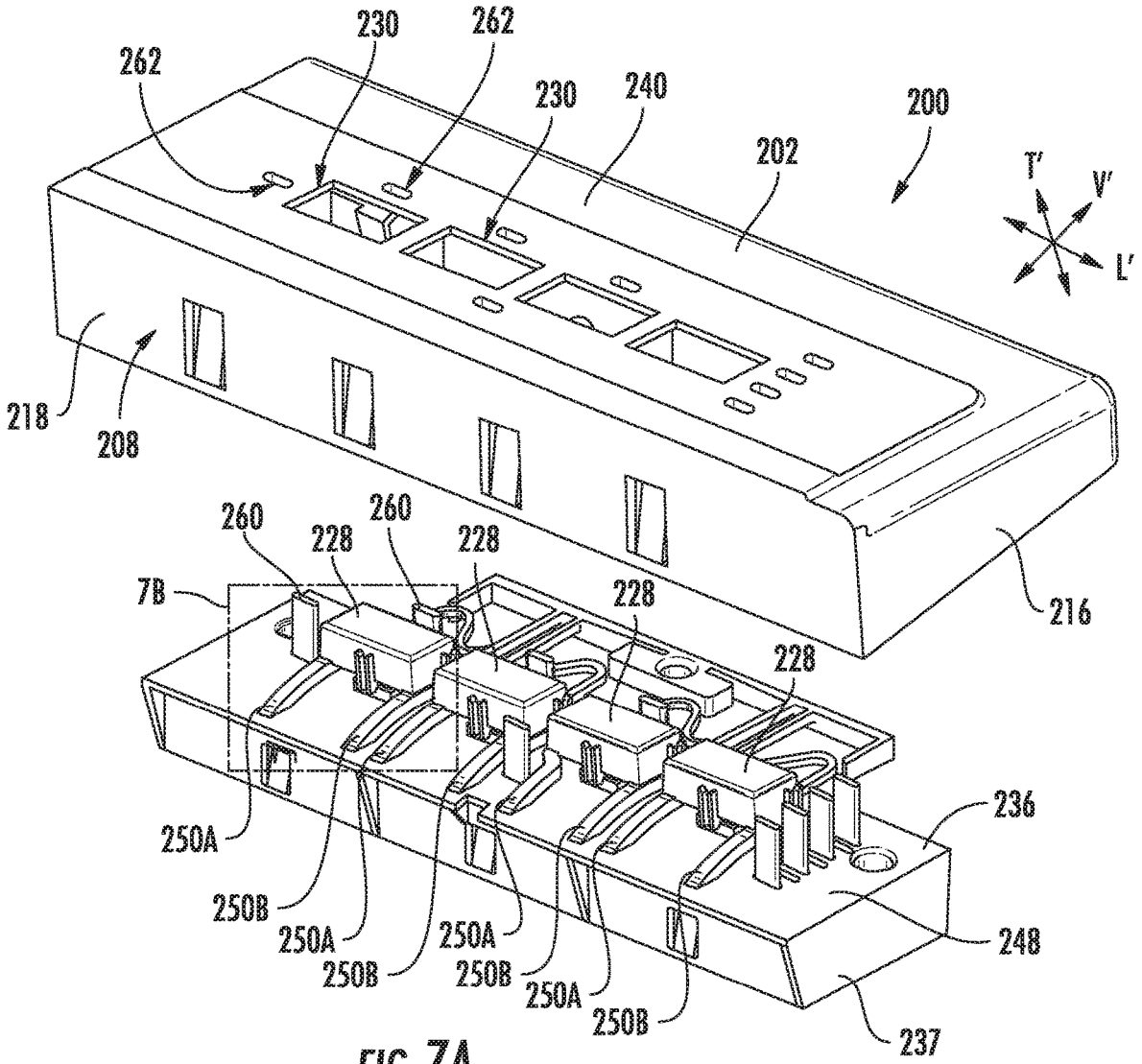
FIG. 7A provides a partially-exploded perspective view of an alternative appliance user interface.
Figure 7B:
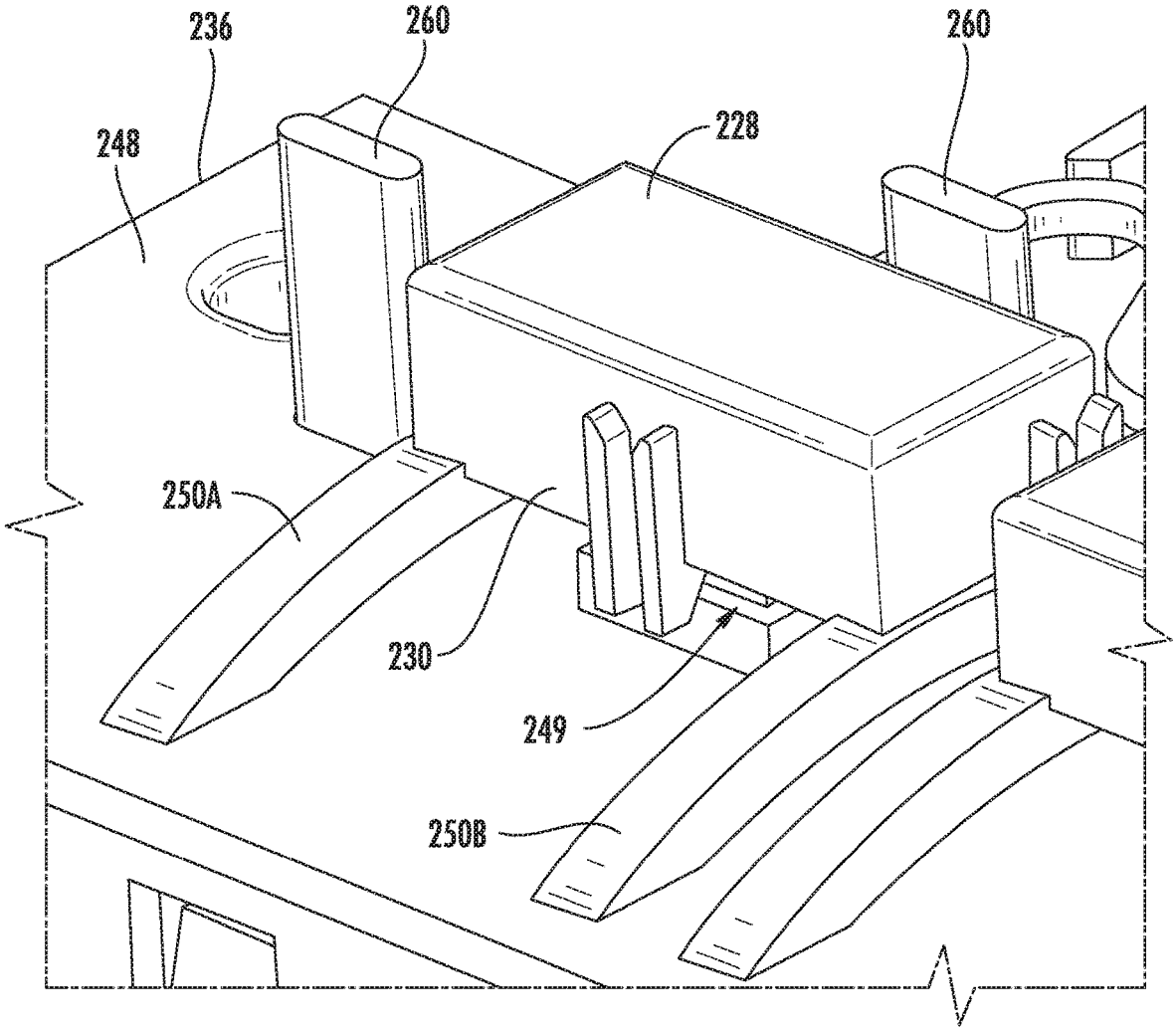
FIG. 7B provides a magnified perspective view of the portion 7B identified in FIG. 7A.

Turning briefly to FIGS. 7A and 7B, a partially-exploded perspective view of an alternative embodiment of appliance user interface 200 is provided, including a magnified view thereof. Except as otherwise indicated, it is understood that the embodiments of FIGS. 7A and 7B may include some or all of the features of the embodiments discussed with respect to FIGS. 1 through 6B, and vice versa. As shown in FIGS. 7A and 7B, some embodiments of board housing 236 may include multiple resilient cantilevers 250A, 250B in biased engagement with a single button body 230. For instance, a pair of cantilevers 250A, 250B may be positioned at opposite lateral sides of a single button body 230. Optionally, each cantilever 250A, 250B of the pair may be positioned at opposite lateral sides of a single switch aperture 249. In turn, neither cantilever 250A, 250B will be transversely aligned with switch aperture 249. During use, however, the pair of cantilevers 250A, 250B may bias button body 230 forward toward control panel 204, while at least a portion of button body 230 may be moved toward control board 222 (see FIG. 4) and/or through switch aperture 249.

Returning now to FIGS. 4 through 6B, control board 222 is supported on board housing 236. For instance, control board 222 may be bounded in the vertical direction V' and/or lateral direction L' by a housing wall 237 that extends rearward from planar frame 248. One or more support tabs 239 may extend from housing wall 237 and hold control board 222 against a rearward portion of planar frame 248. In turn, control board 222 will be disposed between planar frame 248 and support tab 239 along the transverse direction T'. Additionally or alternatively, one or more mechanical fasteners (e.g., screws, bolts, clips, etc.) and/or adhesives may hold control board 222 on board housing 236.

In certain embodiments, one or more display features are included on appliance user interface 200. For instance, a light source 258 may be mounted on control board 222 (e.g., supported on control board 222 and/or electrically coupled therewith) to display information regarding use and/or operations of an appliance (e.g., dishwasher appliance 100—FIG. 1). In some such embodiments, a light guide 260 is provided on planar frame 248. Specifically, light guide 260 may extend as a translucent or transparent member toward control panel 204 from planar frame 248. Light guide 260 may extend toward control panel 204 (e.g., parallel to the transverse direction T'). Optionally, light guide 260 may be integral with planar frame 248 (e.g., as a unitary monolithic body). Moreover, light guide 260 may be positioned in transverse alignment with light source 258. During use, light emissions from the light source 258 may thus be directed through light guide 260 and to control panel 204. In certain embodiments, a guide aperture 262 is defined through control panel 204. For instance, guide aperture 262 may extend fully through control panel 204 from forward face 224 to rearward face 226 along the transverse direction T'. In some such embodiments, light guide 260 may extend through guide aperture 262.

In additional or alternative embodiments, a light guide 260 may be positioned above switch aperture 249 along the vertical direction V'. In some such embodiments, aperture wall 252 may be formed as a raised arch. The arch of aperture wall 252 may have a point or crown 266 that is vertically aligned with light guide 260 (e.g., directly below light guide 260). From the crown 266, the arch may extend to a bottom portion of planar frame 248. In turn, moisture inadvertently entering enclosed cavity 220 through light aperture wall 252 may be advantageously guided around switch aperture 249, thereby preventing moisture from reaching or otherwise damaging control board 222.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance user interface defining a mutually perpendicular vertical direction, lateral direction, and transverse direction, the appliance user interface comprising:

a control panel;

a button body slidably mounted to the control panel;

a board housing disposed behind the control panel along the transverse direction, the board housing comprising a planar frame defining a switch aperture in transverse alignment with the button body, and a resilient cantilever extending from the planar frame in forward biased engagement with the button body; and a control board fixed to the board housing, the control board comprising a contact switch positioned rearward from the planar frame in transverse alignment with the switch aperture to selectively engage the button body, wherein the resilient cantilever extends forward from the planar frame toward the button body, and wherein the resilient cantilever is positioned in front of the switch aperture in transverse alignment therewith.

2. The appliance user interface of claim 1, wherein the control panel defines a panel aperture, and wherein the button body is slidably mounted within panel aperture.

3. The appliance user interface of claim 2, further comprising a flanged edge extending from button body radially outward from the panel aperture.

4. The appliance user interface of claim 2, wherein the control panel comprises an opposing forward face and rearward face, and wherein the control panel comprises a perimeter wall extending along the transverse direction toward the planar frame from the rearward face about the panel aperture.

5. The appliance user interface of claim 1, further comprising a light guide extending toward the control panel from the planar frame.

6. The appliance user interface of claim 5, wherein the control panel defines a guide aperture, and wherein the light guide extends through the guide aperture.

7. The appliance user interface of claim 5, wherein the control board comprises a light source positioned in transverse alignment with the light guide.

8. The appliance user interface of claim 1, wherein the board housing further comprises an embossed lip extending forward along the transverse direction from the planar frame toward the control panel.

9. The appliance user interface of claim 1, wherein the cantilever is integral with planar frame.

10. A dishwasher appliance defining a mutually perpendicular vertical direction, lateral direction, and transverse direction, the dishwasher appliance comprising:

a cabinet defining an interior;

a tub disposed within the interior and defining a wash chamber for the receipt of articles for cleaning;

a control panel mounted to the cabinet;

a button body slidably mounted to the control panel;

a board housing disposed behind the control panel along the transverse direction, the board housing comprising a planar frame defining a switch aperture in transverse alignment with the button body, and a resilient cantilever extending from the planar frame in forward biased engagement with the button body; and a control board fixed to the board housing, the control board comprising a contact switch positioned rearward from the planar frame in transverse alignment with the switch aperture to selectively engage the button body, wherein the resilient cantilever extends forward from the planar frame toward the button body, and wherein the resilient cantilever is positioned in front of the switch aperture in transverse alignment therewith.

11. The dishwasher appliance of claim 10, wherein the control panel defines a panel aperture, and wherein the button body is slidably mounted within panel aperture.

12. The dishwasher appliance of claim 11, further comprising a flanged edge extending from button body radially outward from the panel aperture.

13. The dishwasher appliance of claim 11, wherein the control panel comprises an opposing forward face and rearward face, and wherein the control panel comprises a perimeter wall extending along the transverse direction toward the planar frame from the rearward face about the panel aperture.

14. The dishwasher appliance of claim 10, further comprising a light guide extending toward the control panel from the planar frame.

15. The dishwasher appliance of claim 14, wherein the control panel defines a guide aperture, and wherein the light guide extends through the guide aperture.

16. The dishwasher appliance of claim 14, wherein the control board comprises a light source positioned in transverse alignment with the light guide.

17. The dishwasher appliance of claim 10, wherein the board housing further comprises an embossed lip extending forward along the transverse direction from the planar frame toward the control panel.

18. The dishwasher appliance of claim 10, wherein the cantilever is integral with planar frame.

19. An appliance user interface defining a mutually perpendicular vertical direction, lateral direction, and transverse direction, the appliance user interface comprising:

a control panel defining a panel aperture;

a button body slidably mounted to the control panel within the panel aperture;

a board housing disposed behind the control panel along the transverse direction, the board housing comprising a planar frame defining a switch aperture in transverse alignment with the button body, and a resilient cantilever extending from the planar frame in forward biased engagement with the button body; and a control board fixed to the board housing, the control board comprising a contact switch positioned rearward from the planar frame in transverse alignment with the switch aperture to selectively engage the button body, wherein the resilient cantilever extends forward from the planar frame toward the button body, wherein the resilient cantilever is positioned behind the panel aperture in transverse alignment therewith, and wherein the resilient cantilever is positioned in front of the switch aperture in transverse alignment therewith.

* * * * *